United States Patent [19]

Stahlecker

[11] Patent Number: 4,991,263

[45] Date of Patent: Feb. 12, 1991

[54] SPINNING MACHINE DRAFTING UNIT ARRANGEMENT

[75] Inventor: Fritz Stahlecker, 7347 Bad Überkingen, Bad Überkingen, Fed. Rep. of Germany

[73] Assignee: Hans Stahlecker, Fed. Rep. of Germany; a part interest

[21] Appl. No.: 455,187

[22] Filed: Dec. 22, 1989

[30] Foreign Application Priority Data

Dec. 28, 1988 [DE] Fed. Rep. of Germany ..... 3844072

[51] Int. Cl.[5] ..... D01H 5/74

[52] U.S. Cl. ..... 19/258; 19/265; 19/293; 19/236

[58] Field of Search ..... 19/236, 258, 293, 265; 57/92, 93, 97, 102

[56] References Cited

U.S. PATENT DOCUMENTS

| | | | |
|---|---|---|---|
| 3,212,168 | 10/1965 | Sommer | 19/258 |
| 3,228,088 | 1/1966 | Schaeffler et al. | 19/258 |
| 3,373,556 | 3/1968 | Stahleckor et al. | 57/92 |
| 3,421,306 | 1/1969 | Herubel | 57/102 |
| 4,164,113 | 8/1979 | Thompson | 57/93 |
| 4,662,859 | 5/1987 | Sakai et al. | 464/154 |
| 4,916,891 | 4/1990 | Landwehrkamp et al. | 57/92 |

FOREIGN PATENT DOCUMENTS

| | | | |
|---|---|---|---|
| 1510705 | 1/1971 | Fed. Rep. of Germany . | |
| 2256052 | 5/1973 | Fed. Rep. of Germany | 57/92 |
| 3417501 | 1/1985 | Fed. Rep. of Germany | 19/258 |
| 59-15519 | 1/1984 | Japan . | |
| 9001727 | 1/1984 | Japan | 19/293 |
| 9001728 | 1/1984 | Japan | 19/293 |
| 62-162029 | 7/1987 | Japan . | |

*Primary Examiner*—Werner H. Schroeder
*Assistant Examiner*—Michael A. Neas
*Attorney, Agent, or Firm*—Evenson, Wands, Edwards, Lenahan & McKeown

[57] ABSTRACT

In the case of a spinning machine having a plurality of drafting units, which each contain several top rollers and bottom rollers, and in which the bottom rollers are each constructed as roller sections which can be individually separated form a central drive, it is provided that the bottom rollers are constructed as hollow cylinders which are disposed on stationary shafts.

31 Claims, 3 Drawing Sheets

SPINNING MACHINE DRAFTING UNIT ARRANGEMENT

BACKGROUND AND SUMMARY OF THE INVENTION

The invention relates to a spinning machine having a plurality of drafting units which each contain several top rollers and bottom rollers, the bottom rollers being constructed as roller sections which are disposed individually and are connected to a drive by means of driving elements which contain shiftable couplings.

Spinning machines having drafting units of the initially mentioned type are known on the basis of JP-A 59-15519, JP-A 62-162029 and DE-A 15 10 705. In the known constructions, the bottom rollers consist of a roller body which is pressed onto a shaft section. The shaft section is horizontally carried by means of roller bearings in holding devices of the machine frame. The moving area of the sliver, in which the top rollers are pressed against the bottom rollers, is therefore situated at a relative large distance from the roller bearings.

An object of the invention is to develop a spinning machine of the initially mentioned type in such a manner that a construction that is as compact as possible and favorable bearing loads are obtained.

This object is achieved according to preferred embodiments of the invention in that the bottom rollers are hollow cylinders which are disposed on stationary shafts.

By means of this development, it is possible to dispose the bottom rollers such that the deflections caused by loads do not result in an increased loading of the roller bearings. In addition, a very compact construction is achieved.

In an advantageous further development of preferred embodiments of the invention, it is provided that the hollow cylinders are each carried by means of roller bearings which are arranged at least approximately symmetrically with respect to the moving area of a sliver. In this case, it is important that the roller bearings are arranged on both sides of this running area of the sliver, so that no tiltings occur in the area of the bearings.

A particularly simple construction is obtained according to preferred embodiments of the invention if the hollow cylinders are, in each case, disposed on shaft stubs which are clamped in an overhung manner into a part of the machine frame. The shaft stubs, which may also be called stud bolts, may be pressed or clamped in a simple manner into holding devices without any resulting problems with respect to space. In particular, advantages are also achieved for the mounting and the dismounting because the holding device can be detached and fastened again without the risk that, the bearings are subjected to an additional load as a result of an excessive stress.

In a further development of preferred embodiments of the invention, it is provided that the hollow cylinders are designed as the outer bearing ring for roller bodies. As a result, favorable dimensions may be achieved for the shaft stubs and the bottom rollers which permit high stability and stiffness while the overall dimensions do not become too large. For the same purpose, it is provided in a further development of the invention that the roller bodies run directly on the respective shaft stub.

In a further development of preferred embodiments of the invention, a common actuating element is provided for the couplings of several bottom rollers of a drafting unit. As a result, it is possible to stop the drafting unit in such a manner that an interruption of the sliver in the drafting unit is avoided so that no difficulties arise when the drafting unit is switched on again. For the same purpose, it is advantageous for a braking device to be assigned to the bottom rollers. As a result, it is possible to stop the bottom rollers in a defined manner.

Other objects, advantages and novel features of the present invention will become apparent from the following detailed description of the invention when considered in conjunction with the accompanying drawings.

DETAILED DESCRIPTION OF THE DRAWINGS

Figure 1:
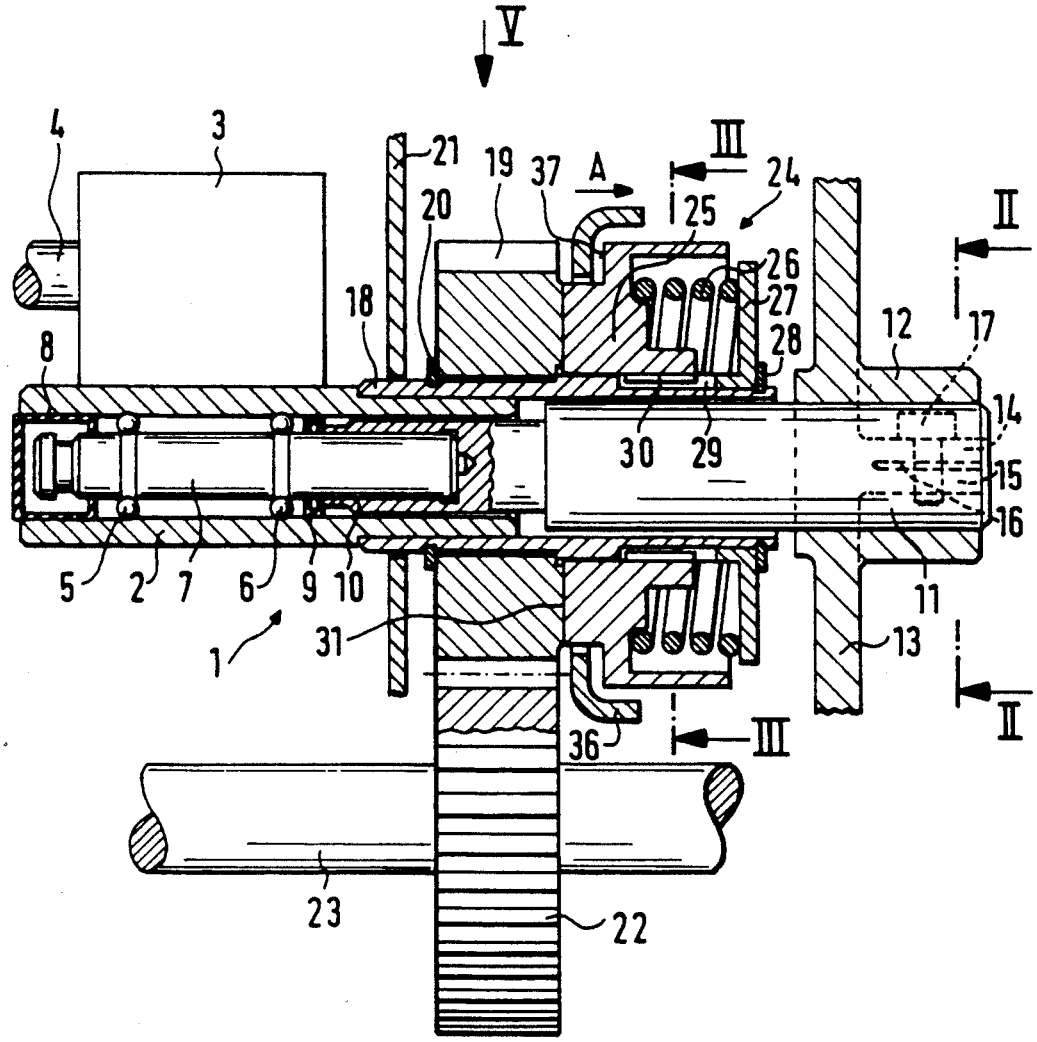
FIG. 1 is a longitudinal sectional view of a construction of a bottom roller of a drafting unit as well as its driving elements, constructed according to a preferred embodiment of the invention.

The shown drafting unit 1 contains several pairs of rollers 2, 3 which, in a conventional manner, form drafting and condenser zones and which are used for drawing a sliver (F) to the desired yarn size. A spinning machine is provided with a plurality of spinning points to which the drafting units 1 are assigned individually or, if a double yarn is to be produced, in pairs. The roller pairs of the drafting unit each consist of a top roller 3, which, in a conventional manner, is disposed on a shaft 4. Normally, the top rollers 3, are arranged in pairs on a shaft 4 which is held by a load carrier which is not shown. The top rollers 3, which may be adjustable by means of a given contact pressure, are pressed against the bottom rollers 2. In a manner not shown in detail, apron guides may be provided inside the drafting or condenser zones. The bottom rollers 2 are driven in a manner which will be explained below. The top rollers 3 are taken along as a result of a friction effect. The driving takes place by means of shafts 23 extending through in longitudinal direction of the machine which, at the machine end in a driving frame, are driven by one or several driving motors and transmissions. In the embodiment shown, the shaft 23 is in each case assigned to a bottom roller 2. By means of a shaft which extends through, it is also possible to drive several bottom rollers, which follow one another in the moving direction (D) of the sliver 11 by means of driving elements originating from a common shaft 23.

Despite the common drive of the bottom rollers 2 by means of the shafts 23 extending through in longitudinal direction of the machine, it must be possible to stop the individual bottom rollers 2 of a drafting unit 1 without interrupting the drive of the shafts 23 so that the operation of adjacent drafting units is not disturbed.

In a manner not shown in detail, the bottom rollers are provided with a ribbing in the area guiding the sliver (F). The bottom rollers 2 are constructed as individual hollow cylinders whiCh are disposed on an shaft stub 7, 11 by means of roller bearing bodies. The interior surface of the hollow cylinder is used as an outer race for the roller bodies 5, 6 constructed as balls which move in grooves of the shaft stub 7, 11. The area of the roller bearings is sealed off by inserted sealing elements 8, 9. As shown particularly in FIG. 1, the roller bearings are arranged such that they are arranged on both sides of the area in which the sliver (F) is moving. The shaft stub consists of two parts 7, 11, part 7 having a smaller diameter and being inserted into part 11 having the larger diameter which is provided with a recess 10. Part 11, which again is stepped to form a larger diameter, is clamped in a part 13, such as a roller stand, in an overhung manner. The diameter of the shaft stub 7, 11 therefore increases approximately corresponding to the course of the bending line resulting from the in use loading of same. Machine part 13 is provided with a projection 12 having a clamping slot 16, two lateral tongues 14, 15 projection away from the projection 12 (see also FIG. 2). In the area of these tongues 14, 15, a locking screw 17 is situated by means of which the shaft stub 11 is firmly clamped into the machine part 13. When the locking screw 17 is unscrewed, the shaft stub 11, together with all components attached to it, can be easily taken out, removed and, if necessary, exchanged.

The bottom roller 2 constructed as a hollow cylinder is extended by means of a sleeve 18, into which it is fitted by means of a press fit. A toothed wheel 19 is first loosely arranged on the sleeve 18 and mates with a toothed wheel 22 which is non-rotatably connected with the shaft 23. In addition, a coupling 24 is arranged on the sleeve 18 and consists of a supporting disk 27, which is non-rotatably connected with the sleeve 18 and of a coupling disk 25, which by means of the force of a pressure spring 26 supporting itself at the supporting disk 27, is pressed against a face of the toothed wheel 19. As shown particularly in FIG. 4, a coupling surface 31 which permits a form-locking coupled connection is provided between the toothed wheel 19 and the coupling disk 25. In the embodiment shown, the toothed wheel 19 and the coupling disk 25 are equipped with toothings 34, 35 which correspond to one another and which have essentially axially directed driving surfaces. When the coupling disk 25 is moved in the direction of the arrow (A), the coupling 24 is opened. In the case of a movement in the opposite direction (C), the toothings 32, 33 engage with one another. The supporting disk 27 and the toothed wheel 19 are fixed on the sleeve 18 by means of snap rings 20, 28 arranged on opposite sides.

Figure 3:
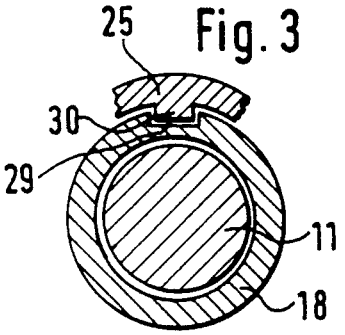
FIG. 3 is a sectional view along Line III—III of FIG. 1.

The coupling disk 25 is equipped with one or several springs 30, as also shown in FIG. 3, which engage in corresponding axial grooves 29 of the sleeve 18. The coupling disk 25 is axially slidable on the sleeve 18. The shifting against the effect of the pressure spring 26 takes place by means of an adjusting element 36, which is held at the machine frame 13 in a manner explained in the following and which can be applied to a projection 37 of the coupling disk 25 in the direction of the arrow (A). The adjusting element 36 places itself against the face 37 of the coupling disk 25 and results not only in an opening of the coupling 24 but also in a braking of the bottom roller 2. In order to increase the braking effect, brake linings may be provided at the face 37 of the coupling disk 25 and/or at the opposite surface of the adjusting element 36. After the coupling disk 25 is detached from the toothed wheel 19, the latter, which continues to be engaged with the toothed wheel 22 of the shaft 23, continues to loosely move on the sleeve 18.

Figure 5:
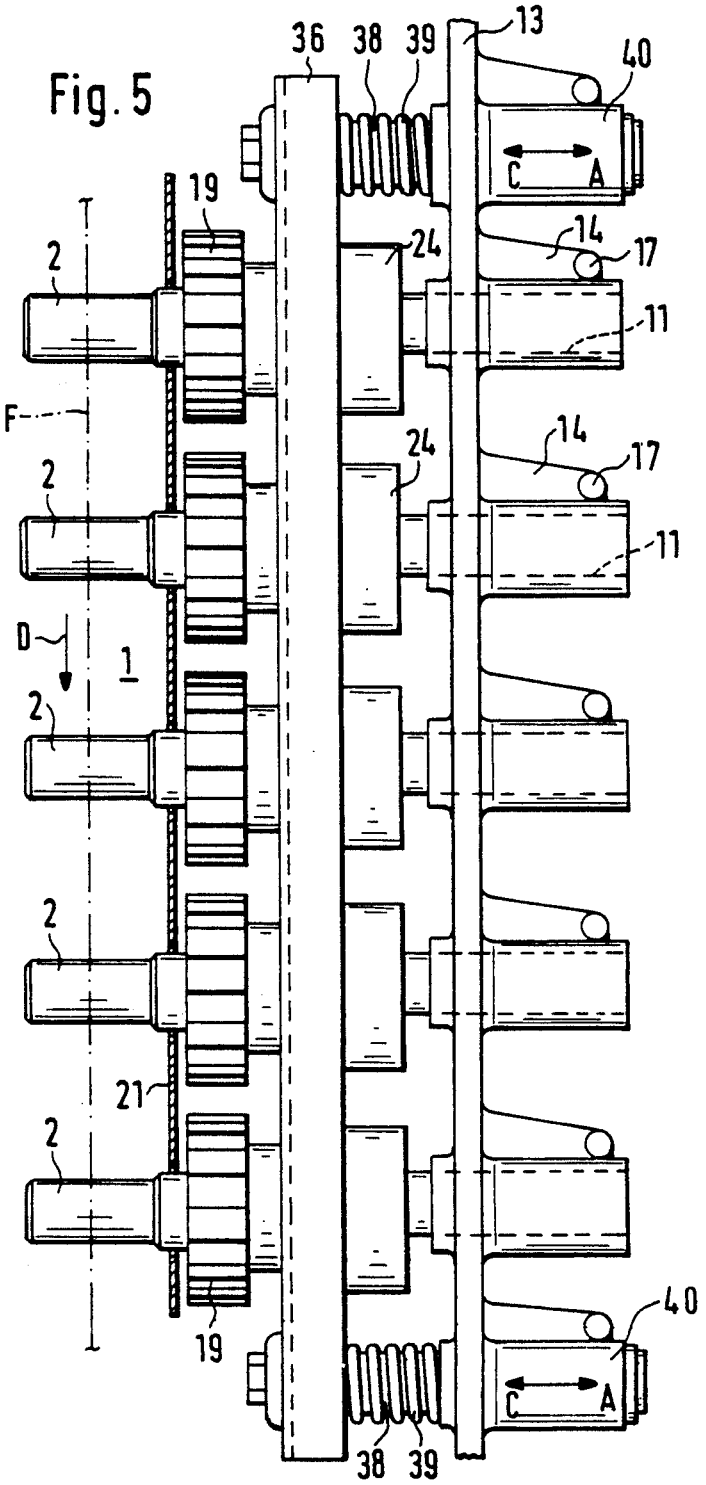
FIG. 5 is a slightly reduced view of the drafting unit of FIG. 1 in the direction of the arrow V while the top rollers are left out.

As shown in FIG. 5, all bottom rollers 2 of the drafting unit 1 are disposed in the same manner and are equipped in the same manner with couplings 24 and driving toothed wheels 19. The opening of the couplings takes place by means of a common control element 36 which is constructed as a U-shaped strip and which, at its end, is slidably guided on pins 38. The pins 38 are clamped in the machine part 13 by means of collets 40. The operative position of the control element 36 is secured by means of pressure springs 39. An adjusting element which is not shown in detail, such as a pneumatic or hydraulic cylinder or a solenoid, is applied to the adjusting element 36. As a result, it is ensured that all bottom rollers 2 of a drafting unit 1 are stopped and restarted simultaneously by means of the common actuating element 36.

Figure 2:
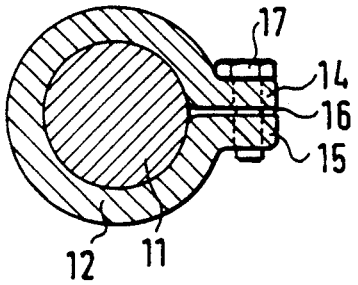
FIG. 2 is a sectional view along Line II—II of FIG. 1.

As shown particularly in FIG. 1, the toothed wheel 19 and the coupling 24 are arranged between the area of the bottom roller guiding the sliver (F) and the stationary machine part 13, into which the shaft stubs 7, 11 are clamped. The area of the top roller 3 and of the bottom roller 2 is separated from the area of the toothed wheels 19 and of the couplings 24 by means of a plate-shaped element 21, such as a separating plate.

As a modification of the shown embodiment, it is provided that the plug-type connections between the parts 7, 11 of the shaft stub and/or between the hollow cylinder serving as the bottom roller 2 and the sleeve 18 are not constructed as a press fit but as a close sliding fit, in which case then an additional connection is provided by means of pins, particularly releasable setscrews. In this case, the bottom roller 2 can then be separated from the other parts and, if necessary, can be exchanged.

Figure 4:
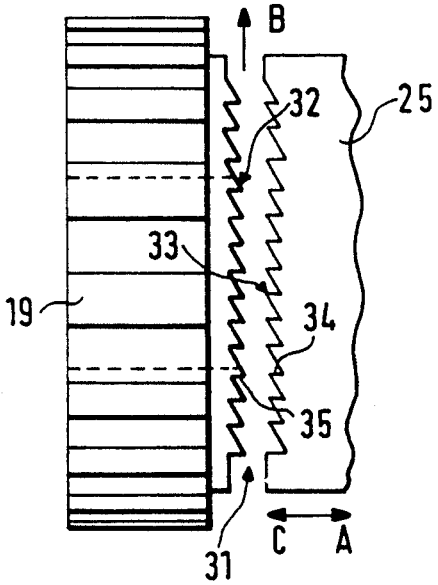
FIG. 4 is a partial view of the embodiment of FIG. 1 in the area between a coupling disk and a toothed wheel.

As a further modification of the shown embodiment, it is provided that, instead of the toothing 32, 33 shown in FIG. 4, another toothing or a frictional connection for the coupling surfaces 31 is provided With respect to safety aspects, the coupling may then be designed in such a manner that, when the torsional resistance is excessive, the bottom roller 2 will stop without any opening of the coupling 24.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A spinning machine sliver drafting arrangement having a plurality of drafting units which each contain several top rollers and bottom rollers, the bottom rollers being constructed as roller sections disposed individually and connected to a drive by means of driving elements including shiftable couplings, wherein the bottom rollers are hollow cylinders which are rotatably disposed on stationary shafts.

2. A spinning machine drafting arrangement according to claim 1, wherein the hollow cylinders are each rotatably supported by means of roller bearings which are arranged at least approximately symmetrically with respect to a moving area of a sliver being drafted.

3. A spinning machine drafting arrangement according to claim 1, wherein the hollow cylinders are each disposed on shaft stubs clamped in an overhung manner into a part of the machine frame.

4. A spinning machine drafting arrangement according to claim 2, wherein the hollow cylinders are each disposed on shaft stubs clamped in an overhung manner into a part of the machine frame.

5. A spinning machine drafting arrangement according to claim 1, wherein the hollow cylinders are constructed as outer bearing rings for roller bodies of roller bearings.

6. A spinning machine drafting arrangement according to claim 5, wherein the roller bodies run directly on a respective shaft stub.

7. A spinning machine drafting arrangement according to claims 3, wherein the shaft stubs have a smaller diameter in the area of the roller bearings, than in their clamping-in area.

8. A spinning machine drafting arrangement according to claim 1, wherein a driving wheel is arranged coaxially to the hollow cylinder, said driving wheel being connected with the hollow cylinder by means of a shiftable coupling.

9. A spinning machine drafting arrangement according to claim 7, wherein a driving wheel is arranged coaxially to the hollow cylinder, said driving wheel being connected with the hollow cylinder by means of a shiftable coupling.

10. A spinning machine drafting arrangement according to claim 8, wherein the driving wheel and the coupling are arranged on the hollow cylinder.

11. A spinning machine drafting arrangement according to claim 9, wherein the driving wheel and the coupling are arranged on the hollow cylinder.

12. A spinning machine drafting arrangement according to claim 11, wherein the driving wheel and the coupling are arranged between a moving area of a sliver and the part of the machine frame receiving the shaft stub.

13. A spinning machine drafting arrangement according to claim 12, wherein the area of the driving wheel and of the coupling is separated from a moving area of a sliver by means of a separating element.

14. A spinning machine drafting arrangement according to claim 13, wherein the shaft stubs are each composed of two parts non-rotatably connected with one another and one of said two parts receiving the roller bearings and the other of said two parts being clamped into a part of the machine frame.

15. A spinning machine drafting arrangement according to claim 14, wherein each hollow cylinder is composed of two sections respectively, one of said two sections forming the actual bottom roller assigned to the top rollers and the other of said two sections forming an extension, in the area of the driving wheel and the coupling.

16. A spinning machine drafting arrangement according to claim 15, a common actuating element is provided for the couplings of several bottom rollers of a drafting unit.

17. A spinning machine drafting arrangement according to claim 8, a common actuating element is provided for the couplings of several bottom rollers of a drafting unit.

18. A spinning machine according to claim 16, wherein a braking device being shiftable together with is assigned to the bottom rollers.

19. A spinning machine according to claim 17, wherein a braking device being shiftable together with is assigned to the bottom rollers.

20. A spinning machine according to claim 8, wherein a braking device being shiftable together with is assigned to the bottom rollers.

21. A spinning machine drafting arrangement according to claim 8, wherein the coupling contains an axially slidable coupling disk non-rotatably connected with the hollow cylinder and can be coupled with the driving wheel loosely arranged on the hollow cylinder.

22. A spinning machine according to claim 21, wherein a form-locking coupled connection is provided between the driving wheel and the coupling disk.

23. A spinning machine drafting arrangement according to claim 19, wherein the coupling contains an axially slidable coupling disk non-rotatably connected with the hollow cylinder and can be coupled with the driving wheel loosely arranged on the hollow cylinder.

24. A spinning machine according to claim 22, wherein a form-locking coupled connection is provided between the driving wheel and the coupling disk.

25. A bottom drafting roller for a sliver drafting arrangement of the type having a plurality of drafting units each including several top rollers and bottom rollers, said bottom drafting roller being formed as a hollow drafting roller body mountable on a stationary shaft and bearing means for rotatably drivably supporting said roller body on the stationary shaft.

26. A bottom drafting roller arrangement according to claim 25, comprising bearing means in the form of roller bearings disposed along an axial portion of the hollow drafting roller body subjected to moving said sliver during drafting.

27. A bottom drafting roller arrangement according to claim 26, wherein said roller bearings are arranged at least approximately symmetrically with respect to the moving sliver during drafting.

28. A bottom drafting roller arrangement according to claim 25, comprising a shaft stub forming the stationary shaft.

29. A bottom drafting roller arrangement according to claim 26, comprising a shaft stub forming the stationary shaft.

30. A bottom drafting roller arrangement according to claim 29, wherein the hollow roller body forms an outer bearing ring for roller bodies of the roller bearings.

31. A bottom drafting roller according to claim 30, wherein the roller bodies run directly on the shaft stub during drafting.

* * * * *